US009464833B2

(12) United States Patent
McMasters et al.

(10) Patent No.: US 9,464,833 B2
(45) Date of Patent: Oct. 11, 2016

(54) REFRIGERANT CONVERSION KIT AND METHOD FOR A REFRIGERANT RECOVERY UNIT

(75) Inventors: Mark McMasters, Owatonna, MN (US); Tim Wagaman, Owatonna, MN (US)

(73) Assignee: Bosch Automotive Service Solutions Inc., Warren, MI (US)

( * ) Notice: Subject to any disclaimer, the term of this patent is extended or adjusted under 35 U.S.C. 154(b) by 911 days.

(21) Appl. No.: 13/468,848

(22) Filed: May 10, 2012

(65) Prior Publication Data

US 2013/0298578 A1 Nov. 14, 2013

(51) Int. Cl.

*F25B 45/00* (2006.01)
*F25B 43/00* (2006.01)
*F25B 49/00* (2006.01)

(52) U.S. Cl.

CPC ..... *F25B 45/00* (2013.01); *F25B 43/003* (2013.01); *F25B 49/00* (2013.01); *F25B 2345/001* (2013.01); *F25B 2345/002* (2013.01); *F25B 2345/003* (2013.01); *F25B 2345/0051* (2013.01); *F25B 2345/0052* (2013.01); *F25B 2400/18* (2013.01)

(58) Field of Classification Search

CPC ..... F25B 45/00
USPC ..... 62/77, 149, 292, 298–300, 303
See application file for complete search history.

(56) References Cited

U.S. PATENT DOCUMENTS 3,813,893 A * 6/1974 Gemender et al. ..... 62/129
5,025,633 A * 6/1991 Furmanek ..... 62/77
5,095,713 A 3/1992 Laukhuf et al.
5,353,603 A 10/1994 Outlaw et al.
6,185,945 B1 2/2001 Pfefferle et al.
6,202,433 B1 3/2001 Murray et al.
7,107,781 B2 * 9/2006 Quest et al. ..... 62/292
2006/0130510 A1 * 6/2006 Murray et al. ..... 62/292
2006/0130511 A1 * 6/2006 Brown et al. ..... 62/292
2007/0044499 A1 * 3/2007 Reilly, Jr. ..... 62/298
2008/0000240 A1 1/2008 Bakker et al.
2008/0099190 A1 * 5/2008 Singh et al. ..... 165/104.21
2009/0145143 A1 * 6/2009 McMasters ..... 62/149

(Continued)

FOREIGN PATENT DOCUMENTS

DE 4319051 A1 * 12/1994 ..... F25B 45/00
EP 2 360 040 2/2011

OTHER PUBLICATIONS

Machine Translation for DE 4319051.*
Robinair HVAC service tools for Cars and Trucks—The Cool-Tech 34788 Introduction page—by Service Solutions LLC http://www.robinair.com/products/detail.php?id=2370 (accessed Dec. 5, 2012).
International Search Report mailed Sep. 6, 2013.

(Continued)

*Primary Examiner* — Ryan J Walters
*Assistant Examiner* — Antonio R Febles
(74) *Attorney, Agent, or Firm* — Baker Hostetler LLP

(57) ABSTRACT

A method for converting a refrigerant recovery unit from use with a first refrigerant to use with a second refrigerant includes the steps of opening, with a controller, solenoids along a refrigerant path to remove residue of the first refrigerant into a holding vessel, operating a vacuum pump, as indicated by the controller, to further remove the residue of the first refrigerant from the refrigerant path, introducing, via the controller, an amount of the second refrigerant into the refrigerant path, determining, with a refrigerant identifier, a purity of the second refrigerant in the refrigerant path. A kit is also provided to convert the refrigerant recovery unit for use with the first refrigerant to the second refrigerant.

13 Claims, 5 Drawing Sheets

(56) References Cited

U.S. PATENT DOCUMENTS

| | | | | |
|---|---|---|---|---|
| 2009/0188263 | A1 | 7/2009 | Murray et al. | |
| 2009/0188271 | A1 | 7/2009 | McMasters et al. | |
| 2009/0241560 | A1* | 10/2009 | Murray et al. | 62/77 |

OTHER PUBLICATIONS

Reader Air Conditioning, R134a & R1234yf Refrigerants Statistics. Mar. 20, 2012.

* cited by examiner

REFRIGERANT CONVERSION KIT AND METHOD FOR A REFRIGERANT RECOVERY UNIT

FIELD OF THE DISCLOSURE

The disclosure generally relates to a refrigerant recovery unit. More particularly to a conversion kit and associated methods for converting the refrigerant recovery unit that services one type of refrigerant based A/C system to a different refrigerant based A/C system.

BACKGROUND OF THE DISCLOSURE

Vehicle air conditioning (A/C) systems are closed heat exchange systems designed to function with a specific refrigerant as the primary heat exchange medium. In the past, dichlorodifluoromethane, commonly referred to as R-12, was the refrigerant most commonly used in vehicle A/C systems. However, due to the ozone depleting effects of R-12 on the earth's atmosphere, vehicle A/C systems were eventually converted from using R-12 to using tetrafluoroethane, commonly referred to as R-134a. In recent years, continuing concerns over global warming resulted in the adoption of new requirements in Europe and other countries that, for example, required development of a new class of refrigerants having a lower global warming potential (GWP) than that of R-134a. In response, 2,3,3,3-tetrafluoropropene, or R-1234yf, and difluoroethane, or R-152a, were recently developed, which have significantly lower GWPs than R-134a and a significantly shorter atmospheric lifetime. In turn, some auto manufacturers have announced intentions to begin adopting the more environmentally friendly refrigerants to replace R-134a in newer model cars, which will be phased in on new vehicle platforms over a period of several years.

Refrigerant recovery units are used for the maintenance and servicing of vehicle A/C systems, which may include, for example, the recovery, evacuation, recycling and/or recharging of the refrigerant in the A/C systems. A refrigerant recovery unit may be a portable system that connects to the A/C system of a vehicle to recover refrigerant out of the system, separate out contaminants and oil, and/or recharge the A/C system with additional refrigerant Because of the extreme variation in the properties of the different types of refrigerants, each refrigerant recovery unit is designed for use with a specific refrigerant.

Accordingly, an industry conversion from use of one refrigerant, e.g., R-134a, to use of a different refrigerant, e.g., R-1234yf, presents extreme challenges for those that service vehicle A/C systems. In particular, because refrigerant recovery units are often complex and expensive, and the phase in period of a new refrigerant will occur over a period of many years, a service provider is often forced to predict when over the lifecycle of the phase in period it is most prudent to make a capital investment in a new recovery unit for servicing vehicles with the new refrigerant. For example, a service provider may have a growing, thriving business in servicing vehicle A/C systems and would like to purchase an additional refrigerant recovery unit to meet the growing demand. Purchasing a new recovery unit designed for the old refrigerant might enable the service provider to meet today's growing demand for vehicles using the old refrigerant. However, the service provider may resist making the investment knowing that the unit will eventually become obsolete as most vehicles convert to using the new refrigerant. The service provider may, instead, invest in a new recovery unit designed for the new refrigerant, sacrificing the ability to grow and profit today for the ability to meet a growing demand in the future.

A need exists for methods and systems that will provide the capability to easily and effectively convert a refrigerant recovery unit designed for use with one refrigerant to use with a different refrigerant.

SUMMARY OF THE DISCLOSURE

The foregoing needs are met, to a great extent, by the present disclosure, wherein in one aspect, a process and a conversion kit are provided to easily migrate a refrigerant recovery unit 100 from a factory set-up, for example, configured to work with one specific refrigerant, to a refrigerant recovery unit 100 converted in the field by an end user to work with a second specific refrigerant.

In accordance with certain aspects of the present invention, a method of converting a refrigerant recovery unit from use with a first refrigerant to use with a second refrigerant includes the steps of opening, with a controller, solenoids along a refrigerant path to remove residue of the first refrigerant into a holding vessel, operating a vacuum pump, as indicated by the controller, to further remove the residue of the first refrigerant from the refrigerant path, introducing, via the controller, an amount of the second refrigerant into the refrigerant path, determining, with a refrigerant identifier, a purity of the second refrigerant in the refrigerant path.

In accordance with other aspects of the present disclosure, a conversion kit for converting a refrigerant recovery unit from use with a first refrigerant to use with a second refrigerant includes a software conversion program for loading onto the refrigerant recovery unit and a new filter for replacing a filter on the refrigerant recovery unit.

In accordance with yet other aspects of the present invention, system for servicing an air conditioning system that uses a first refrigerant includes a refrigerant recovery unit containing residue of a second refrigerant, and a refrigerant conversion kit having a software conversion program for installing on the refrigerant recovery unit to convert the refrigerant recovery unit from servicing an air conditioning system that uses the second refrigerant to servicing the air conditioning system that uses the first refrigerant.

There has thus been outlined, rather broadly, certain aspects of the invention in order that the detailed description herein may be better understood, and in order that the present contribution to the art may be better appreciated.

In this respect, before explaining at least one embodiment of the invention in detail, it is to be understood that the invention is not limited in its application to the details of the construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE DISCLOSURE

A conversion kit and associated methods may be used for converting a refrigerant recovery unit intended to service a particular refrigerant based A/C system to a different refrigerant based A/C system. In particular, a method for converting the refrigerant recovery unit requires clearing the unit of any existing amounts of the previous refrigerant, changing certain hardware components of the refrigerant recovery unit, and updating the software resident on the refrigerant recovery unit to accommodate for the new refrigerant. The software conversion program to run the process must effectively sequence the opening and closing of internal solenoids located on the manifold block and other areas within the refrigerant recovery unit to minimize cross contamination of new and old refrigerant.

Currently, the most common refrigerant used in vehicle refrigerant systems is the HFC-134a. However, new refrigerants are being introduced in order to decrease global warming that can be caused by HFC-134a. These new refrigerants, for example, include HFO-1234yf and R-152a, and can also be used in the various embodiments described herein.

Figure 1:
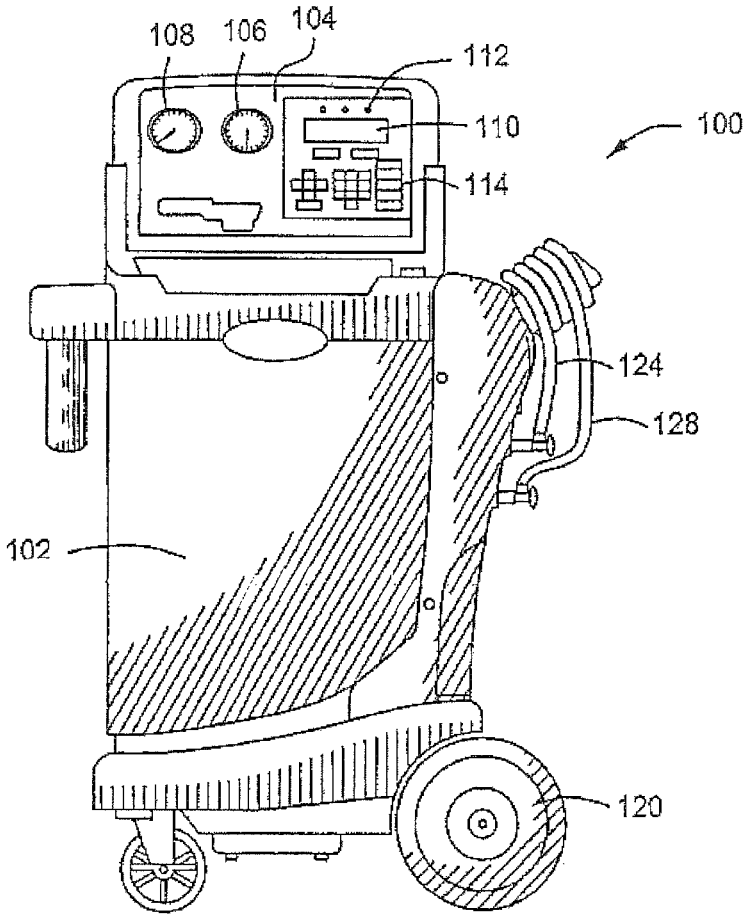
FIG. 1 is a perspective view of a refrigerant recovery unit in accordance with aspects of the present disclosure.

FIG. 1 is a perspective view illustrating a refrigerant recovery unit 100 according to an embodiment of the present disclosure. The refrigerant recovery unit 100 can be the CoolTech 34788™ from Robinair™ based in Owatonna, Minn. (Service Solutions U.S. LLC). The refrigerant recovery unit 100 includes a cabinet 102 to house components of the system (See FIG. 2). The cabinet 102 may be made of any material such as thermoplastic, steel and the like.

The cabinet 102 includes a control panel 104 that allows the user to operate the refrigerant recovery unit 100. The control panel 104 may be part of the cabinet as shown in FIG. 1 or separated. The control panel 104 includes high and low gauges 106, 108, respectively. The gauges may be analog or digital as desired by the user. The control panel 104 has a display 110 to provide information to the user, such as certain operating status of the refrigerant recovery unit 100 or provide messages or menus to the user. Located near the display 110 are LEDs 112 to indicate to the user the operational status of the refrigerant recovery unit 100. A user interface 114 is also included on the control panel 104. The user interface 114 allows the user to interact and operate the refrigerant recovery unit 100 and can include an alphanumeric keypad and directional arrows.

Figure 2:
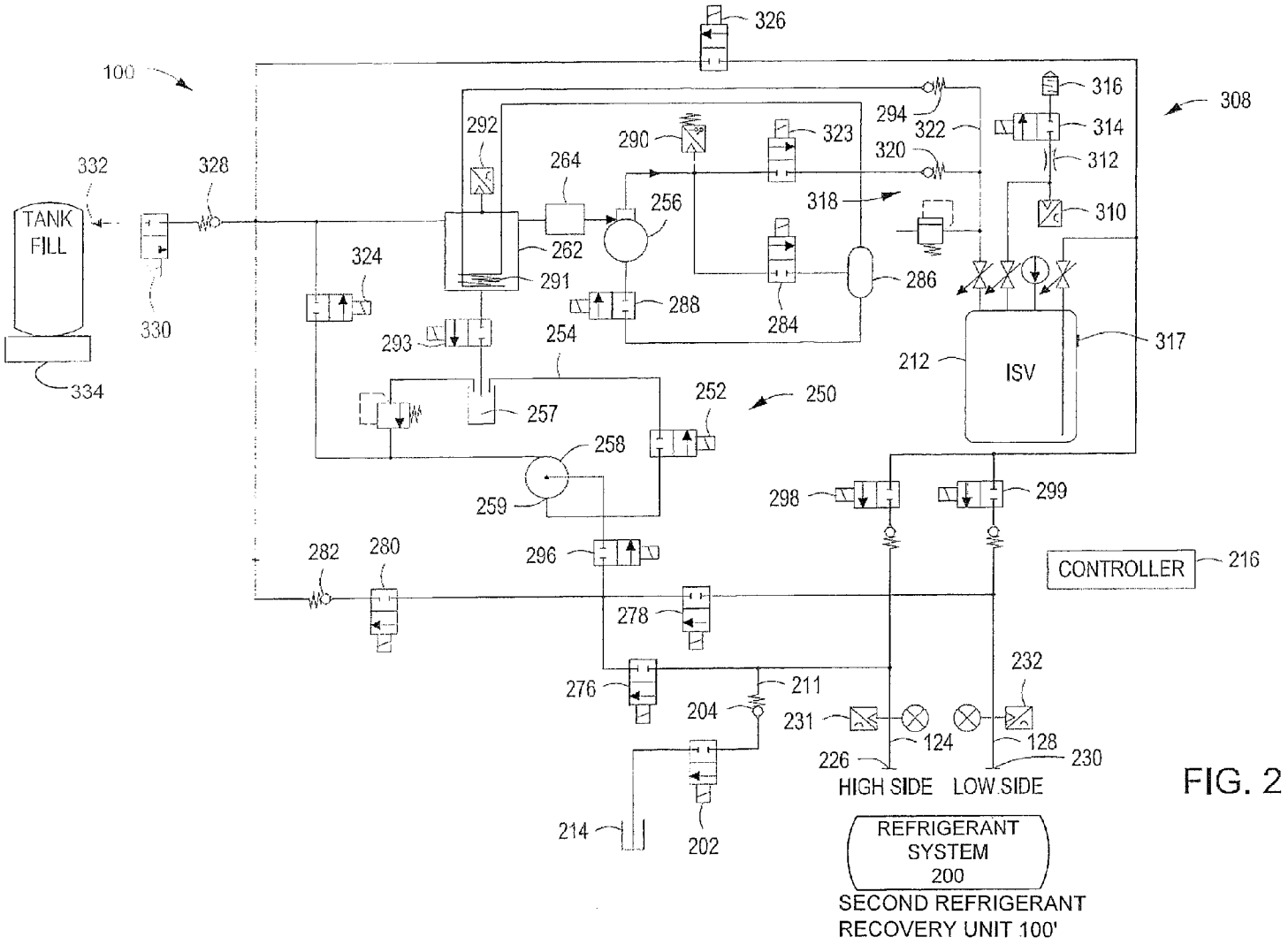
FIG. 2 illustrates components of the refrigerant recovery unit shown in FIG. 1 in accordance with aspects of the present disclosure.

The cabinet 102 further includes connections for hoses 124, 128 that connect the refrigerant recovery unit 100 to a refrigerant containing device, such as the vehicle's refrigerant system 200 (shown in FIG. 2). In order for the refrigerant recovery unit 100 to be mobile, wheels 120 are provided at a bottom portion of the system.

FIG. 2 illustrates components of the refrigerant recovery unit 100 of FIG. 1 according to an embodiment of the present disclosure. In one embodiment, to recover refrigerant, service hoses 124 and 128 are coupled to the refrigeration system 200 of the vehicle, via couplers 226 (high side) and 230 (low side), respectively. The couplers are designed to be closed until they are coupled to the refrigerant system 200.

The recovery cycle is initiated by the opening of high pressure and low-pressure solenoids 276, 278, respectively. This allows the refrigerant within the vehicle's refrigeration system 200 to flow through a recovery valve 280 and a check valve 282. The refrigerant flows from the check valve 282 into a system oil separator 262, where it travels through a filter/dryer 264, to an input of a compressor 256. Refrigerant is drawn through the compressor 256 through a normal discharge solenoid 284 and through a compressor oil separator 286, which circulates oil back to the compressor 256 through an oil return valve 288. The refrigerant recovery unit 100 may include a high-pressure switch 290 in communication with a controller 216, which is programmed to determine an upper pressure limit, for example, 435 psi, to optionally shut down the compressor 256 to protect the compressor 256 from excessive pressure. The controller 216 can also be, for example, a microprocessor, a field programmable gate array (FPGA) or application-specific integrated circuit (ASIC). The controller 216 via a wired or wireless connection (not shown) controls the various valves and other components (e.g. vacuum, compressor) of the refrigerant recovery unit 100. In some embodiments of the present disclosure, any or all of the electronic solenoid or electrically activated valves may be connected and controlled by the controller 216.

A high-side clear solenoid 323 may optionally be coupled to the output of the compressor 256 to release the recovered refrigerant transferred from compressor 256 directly into a storage tank 212, instead of through a path through the normal discharge solenoid 284.

The heated compressed refrigerant exits the oil separator 286 and then travels through a loop of conduit or heat exchanger 291 for cooling or condensing. As the heated refrigerant flows through the heat exchanger 291, the heated refrigerant gives off heat to the cold refrigerant in the system oil separator 262, and assists in maintaining the temperature in the system oil separator 262 within a working range. Coupled to the system oil separator 262 is a switch or transducer 292, such as a low pressure switch or pressure transducer, for example, that senses pressure information, and provides an output signal to the controller 216 through a suitable interface circuit programmed to detect when the pressure of the recovered refrigerant is down to 13 inches of mercury, for example. An oil separator drain valve 293 drains the recovered oil into a container 257. Finally, the recovered refrigerant flows through a normal discharge check valve 294 and into the storage tank 212.

The evacuation cycle begins by the opening of high pressure and low-pressure solenoids 276 and 278 and valve 296, leading to the input of a vacuum pump 258. Prior to opening valve 296, an air intake valve (not shown) is opened, allowing the vacuum pump 258 to start exhausting air. The vehicle's refrigerant system 200 is then evacuated by the closing of the air intake valve and opening the valve 296, allowing the vacuum pump 258 to exhaust any trace gases remaining until the pressure is approximately 29 inches of mercury, for example. When this occurs, as detected by pressure transducers 231 and 232, optionally, coupled to the high side 226 and low side 230 of the vehicle's refrigeration system 200 and to the controller 216, the controller 216 turns off valve 296 and this begins the recharging cycle.

The recharging cycle begins by opening charge valve 298 to allow the refrigerant in storage tank 212, which is at a pressure of approximately 70 psi or above, to flow through the high side of the vehicle's refrigeration system 200. The flow is through charge valve 298 for a period of time programmed to provide a full charge of refrigerant to the vehicle. Optionally, charge valve 299 may be opened to charge the low side. The charge valve 299 may be opened alone or in conjunction with charge valve 298 to charge the vehicle's refrigerant system 200. The storage tank 212 may be disposed on a scale that measures the weight of the refrigerant in the storage tank.

Other components shown in FIG. 2 include an oil inject circuit having an oil inject valve 202 and an oil inject hose or line 211. The oil inject hose 211 is one example of a fluid transportation means for transmitting oil for the refrigerant recovery unit 100. The oil inject hose 211 may be one length of hose or multiple lengths of hose or tubing or any other suitable means for transporting fluid. The oil inject hose 211 connects on one end to an oil inject bottle 214 and on the other end couples to the refrigerant circuit in the refrigerant recovery unit 100. Disposed along the length of the oil inject hose 211 are the oil inject valve 202 and an oil check valve 204. The oil inject path follows from the oil inject bottle 214, through the oil inject solenoid 202, to the junction with the high side charge line, and to the vehicle's refrigerant system 200.

FIG. 2 also illustrates a vacuum pump oil drain circuitry 250 that includes a vacuum pump oil drain valve 252 that is located along a vacuum pump oil drain conduit 254 connecting a vacuum pump oil drain outlet 259 to the container 257 for containing the drained vacuum pump oil. The vacuum pump oil drain valve 252 may be an electronically activated solenoid valve controlled by controller 216. The connection may be a wireless or wired connection. In other embodiments the valve 252 may be a manually activated valve and manually actuated by a user. The conduit 254 may be a flexible hose or any other suitable conduit for provided fluid communication between the outlet 259 and the container 257.

FIG. 2 also illustrates an air purging apparatus 308. The air purging apparatus 308 allows the refrigerant recovery unit 100 to be purged of non-condensable, such as air. Air purged from the refrigerant recovery unit 100 may exit the storage tank 212, through an orifice 312, through a purging valve 314 and through an air diffuser 316. In some embodiments, the orifice may be 0.028 of an inch. A pressure transducer 310 may measure the pressure contained within the storage tank 212 and purge apparatus 308. The pressure transducer 310 may send the pressure information to the controller 216. And when the pressure is too high, as calculated by the controller, purging is required. The valve 314 may be selectively actuated to permit or not permit the purging apparatus 308 to be open to the ambient conditions. A temperature sensor 317 may be coupled to the main tank to measure the refrigerant temperature therein. The placement of the temperature sensor 317 may be anywhere on the tank or alternatively, the temperature sensor may be placed within a refrigerant line 322. The measured temperature and pressure may be used to calculate the ideal vapor pressure for the type of refrigerant used in the refrigerant recovery unit. The ideal vapor pressure can be used to determine when the non-condensable gases need to be purged and how much purging will be done in order to get the refrigerant recovery unit to function properly.

High side clearing valves 318 may be used to clear out part of the high-pressure side of the system. The high side clearing valves 318 may include valve 323 and check valve 320. Valve 323 may be a solenoid valve. When it is desired to clear part of the high side, valve 323 is opened. Operation of the compressor 256 will force refrigerant out of the high pressure side through valves 323 and 320 and into the storage tank 212. During this procedure the normal discharge valve 284 may be closed.

A deep recovery valve 324 is provided to assist in the deep recovery of refrigerant. When the refrigerant from the refrigerant system 200 has, for the most part, entered into the refrigerant recovery unit 100, the remaining refrigerant may be extracted from the refrigerant system 200 by opening the deep recovery valve 324 and turning on the vacuum pump 258.

In another embodiment, in order to charge the refrigerant system 200, the power charge valve 326 may be opened and a tank fill structure 332 may be used. Alternatively or in addition to, the tank fill structure 332 may also be used to fill the storage tank 212. In order to obtain refrigerant from a refrigerant source, the refrigerant recovery unit 100 may include the tank fill structure 332, and valves 328 and 330. The tank fill structure 332 may be configured to attach to a refrigerant source. The valve 330 may be a solenbid valve and the valve 328 may be a check valve. In other embodiments, valve 330 may be a manually operated valve.

When it is desired to allow refrigerant from a refrigerant source to enter the refrigerant recovery unit 100, the tank fill structure 332 is attached to the refrigerant source and the tank fill valve 330 is opened. The check valve 328 prevents refrigerant from the refrigerant recovery unit 100 from flowing out of the refrigerant recovery unit 100 through the tank fill structure 332. When the tank fill structure 332 is not connected to a refrigerant source, the tank fill valve 330 is kept closed. The tank fill valve 330 may be connected to and controlled by the controller 216.

The tank fill structure 332 may be configured to be seated on the scale 334 configured to weigh the tank fill structure 332 in order to determine an amount of refrigerant stored in the tank fill structure 332. The scale 334 may be operatively coupled to the controller 216 and provide a measurement of a weight of the tank fill structure 332 to the controller 216. The controller 216 may cause a display of the weight of the tank fill structure 332 on the display 110.

Figure 3:
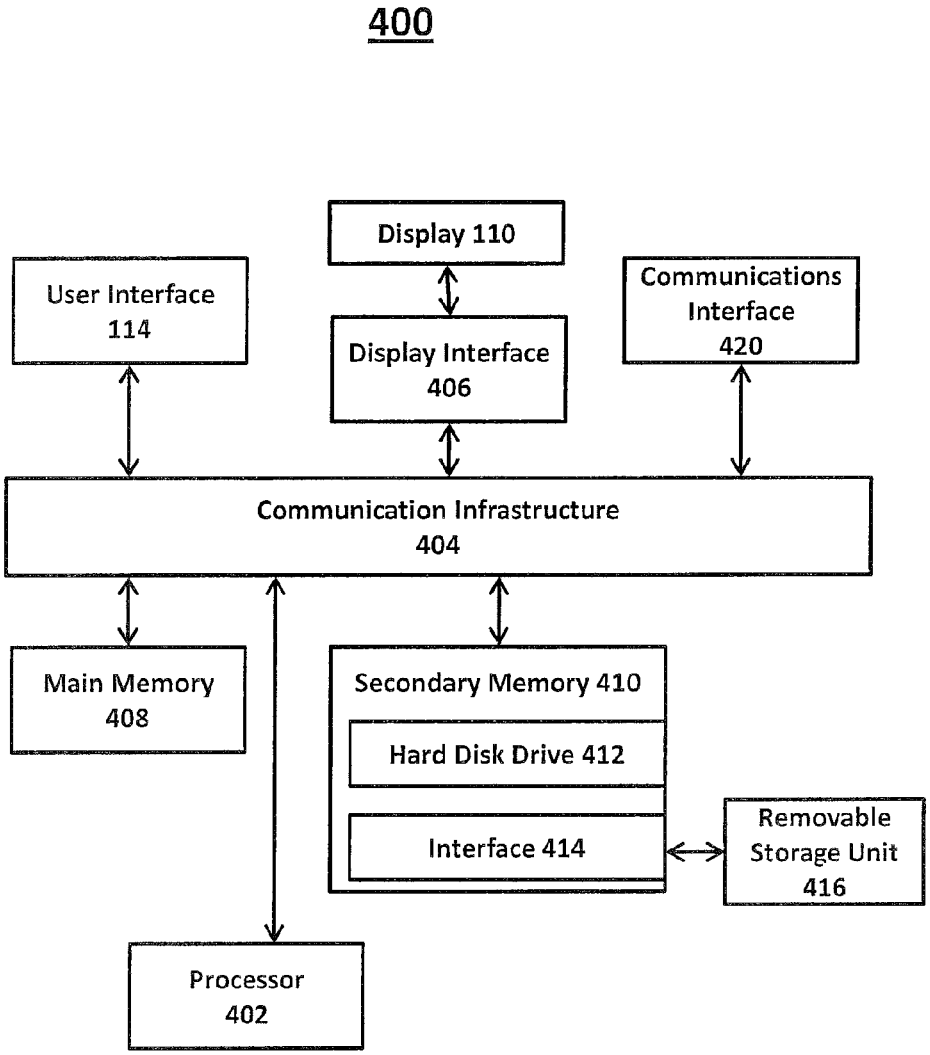
FIG. 3 is a schematic illustrating aspects of a control system, in accordance with aspects of the present disclosure.

Aspects of the refrigerant recovery unit may be implemented via a control system 400 using software or a combination of software and hardware. In one variation, aspects of the present invention may be directed toward a control system 400 capable of carrying out the functionality described herein. An example of such a control system 400 is shown in FIG. 3.

Control system 400 may be integrated with the controller 216 to permit, for example, automation of the recovery, evacuation, and recharging processes and/or manual control over one or more of each of the processes individually. The control system 400 may also provide access to a configurable database of vehicle information so the specifications pertaining to a particular vehicle, for example, may be used to provide exacting control and maintenance of the functions described herein. The control system 400 may include a processor 402 connected to a communication infrastructure 404 (e.g., a communications bus, cross-over bar, or network). The various software and hardware features described herein are described in terms of an exemplary control system. A person skilled in the relevant art(s) will realize that other computer related systems and/or architectures may be used to implement the aspects of the disclosed invention.

The control system 400 may include a display interface 406 that forwards graphics, text, and other data from memory and/or the user interface 114, for example, via the communication infrastructure 404 for display on the display 110. The communication infrastructure 404 may include, for example, wires for the transfer of electrical, acoustic and/or optical signals between various components of the control system and/or other well-known means for providing communication between the various components of the control system, including wireless means. The control system 400 may include a main memory 408, preferably random access memory (RAM), and may also include a secondary memory 410. The secondary memory 410 may include a hard disk drive 412 or other devices for allowing computer programs or other instructions and/or data to be loaded into and/or transferred from the control system 400. Such other devices may include an interface 414 and a removable storage unit 416, including, for example, a Universal Serial Bus (USB) port and USB storage device, a program cartridge and cartridge interface (such as that found in video game devices), a removable memory chip (such as an erasable programmable read only memory (EPROM), or programmable read only memory (PROM)) and associated socket, and other removable storage units 416 and interfaces 414.

The control system 400 may also include a communications interface 420 for allowing software and data to be transferred between the control system 400 and external devices. Examples of a communication interfaces include a modem, a network interface (such as an Ethernet card), a communications port, wireless transmitter and receiver, Bluetooth, Wi-Fi, infra-red, cellular, satellite, a Personal Computer Memory Card International Association (PCMCIA) slot and card, etc.

A software program (also referred to as computer control logic) may be stored in main memory 408 and/or secondary memory 410. Software programs may also be received through communications interface 420. Such software programs, when executed, enable the control system 400 to perform the features of the present invention, as discussed herein. In particular, the software programs, when executed, enable the processor 402 to perform the features of the present invention. Accordingly, such software programs may represent controllers of the control system 400.

In variations where the invention is implemented using software, the software may be stored in a computer program product and loaded into control system 400 using hard drive 412, removable storage drive 416, and/or the communications interface 420. The control logic (software), when executed by the processor 402, causes the controller 216, for example, to perform the functions of the invention as described herein. In another variation, aspects of the present invention can be implemented primarily in hardware using, for example, hardware components, such as application specific integrated circuits (ASICs), field programmable gate array (FPGA). Implementation of the hardware state machine so as to perform the functions described herein will be apparent to persons skilled in the relevant art(s).

Figure 4:
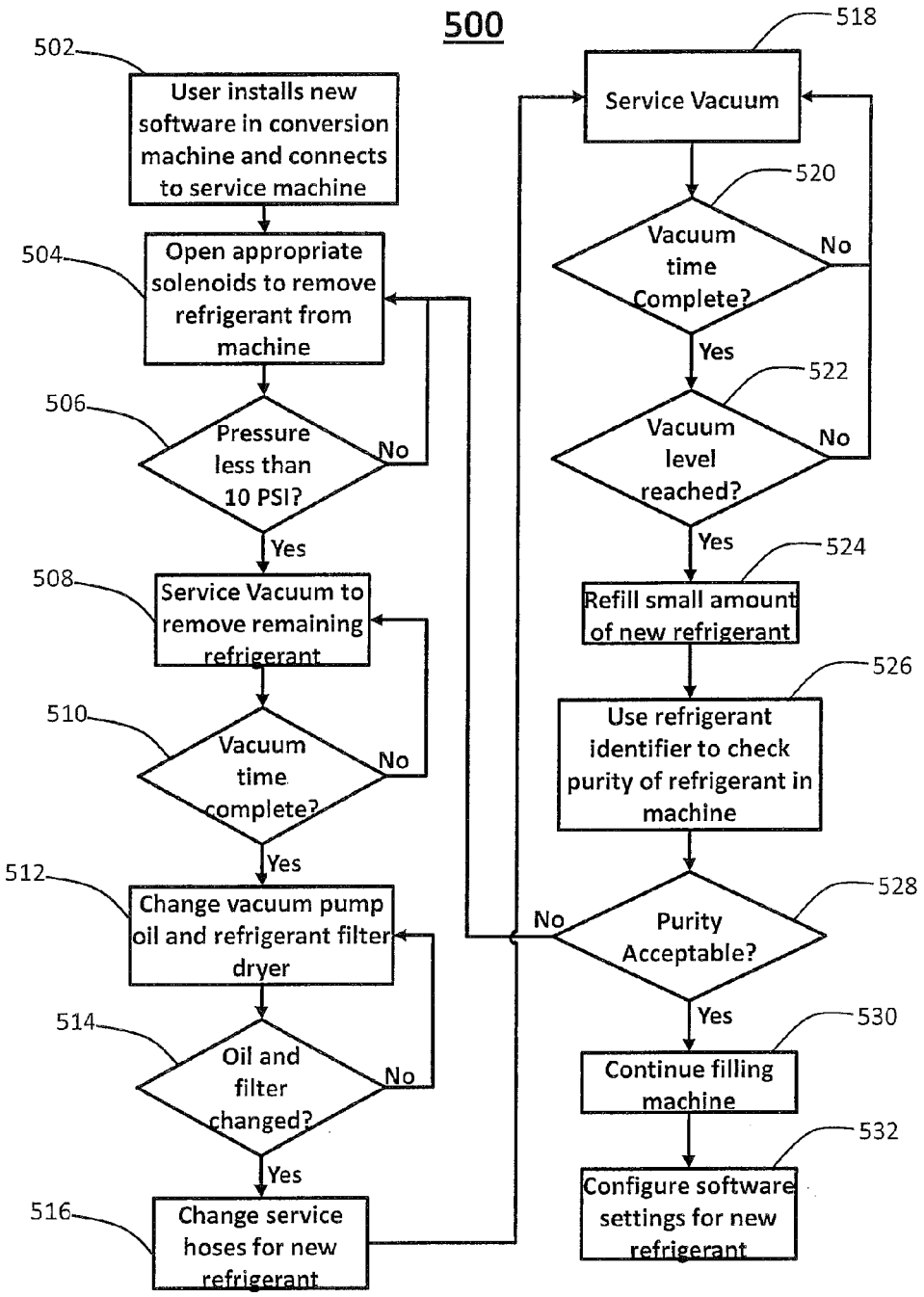
FIG. 4 is a flow diagram for converting the refrigerant recovery unit of FIG. 1 utilizing one type of refrigerant to another type of refrigerant in accordance with aspects of the present disclosure.
Figure 5:
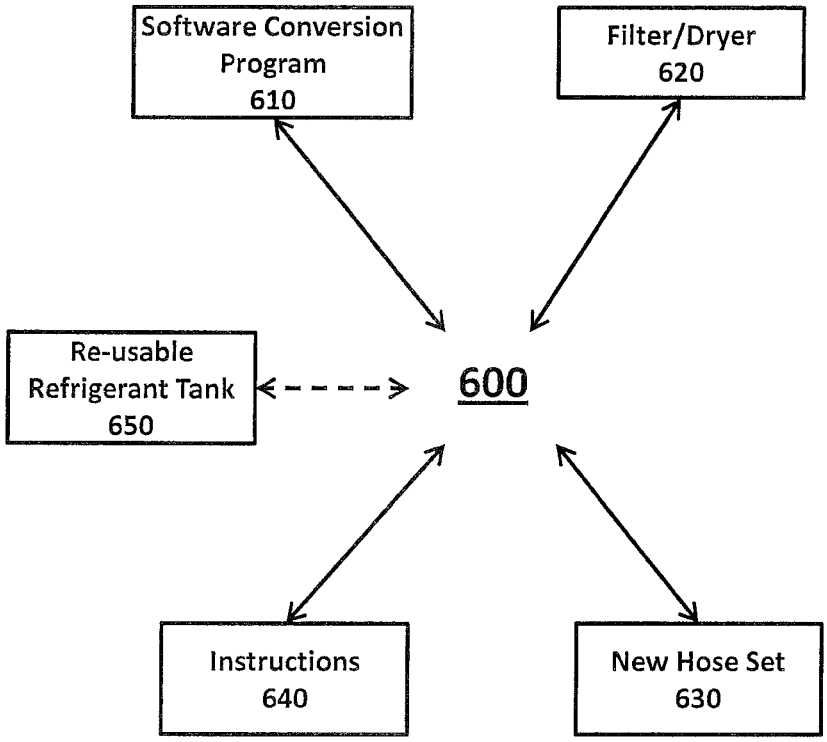
FIG. 5 is a schematic illustrating components of a conversion kit, in accordance with aspects of the present invention.

FIG. 4 is a flow diagram for converting the refrigerant recovery unit of FIG. 1 utilizing one type of refrigerant to another type of refrigerant in accordance with aspects of the present disclosure. This exemplary method 500 may be provided by way of example, as there are a variety of ways to carry out the method. The method 500 shown in FIG. 4 can be executed or otherwise performed by one or a combination of various systems. The method 500 is described below and may be carried out by the system and components shown in FIGS. 1-3, by way of example, and various elements of the system are referenced in explaining the exemplary method of FIG. 4. Each block shown in FIG. 4 represents one or more processes, methods, or subroutines carried out in exemplary method 500. However, the steps do not have to be performed in any certain order or performed at all.

The method 500 takes into account and helps manage the differences in chemical composition of each of the two refrigerants involved in the transition. By substantially automating the conversion process and requiring minimal human interaction on the part of an end user, the method 500 of the present invention substantially reduces or eliminates the potential for cross contamination of the two refrigerants while taking into account safety concerns for the end user. The method 500 involves cleaning the unit 100 of existing amounts of the first refrigerant, updating the unit's software, and scheduling certain hardware component changes at appropriate times to effectively convert the unit 100 to use with the new refrigerant while maintaining acceptable levels of residual refrigerant and cross contamination.

As shown in FIG. 6, a conversion kit 600 may include a software conversion program 610, a new filter/dryer 620, a new hose set 630 having a high pressure hose and a low pressure hose, and instructions 640 for performing the method 500. An optional re-usable refrigerant tank 650 may be included with the kit for collecting the refrigerant from the unit 100 to be converted. The conversion kit 600 may be provided with a newly purchased unit 100, for example, and may also be purchased or provided separately for use with a unit 100 already in the field.

Turning back to FIG. 4, at step 502, the method 500 for converting an exemplary refrigerant recovery unit 100 may begin when the end user installs the software conversion program 610 included with the kit 600. The software conversion program 610 may be stored on a removable storage unit 416, for example, that couples with the interface 414 and kicks off the automated conversion process when the unit 100 is powered up. In other aspects of the present invention, the software conversion program 610 may be downloaded through the communications interface 420, for example, and begin upon execution of a run command input by the end user via the user interface 114. With the software conversion program 610 installed, the refrigerant recovery unit 100 may be connected to a second refrigerant recovery unit 100' via the service hoses 124 and 128, establishing fluid communication between the refrigerant recovery unit 100 and the second refrigerant recovery unit 100' (see FIG. 2). The second refrigerant recovery unit 100' should be configured for use with the first refrigerant. The second refrigerant recovery unit 100' is the same or similar to the refrigerant recovery unit 100 described above. As such, the same reference numbers are used with respect to the same components on the second refrigerant recovery unit 100'.

At step 504, the software conversion program 610 directs the controller 116 to open the appropriate solenoids, 326, 288, 284, 323, 299, and 298 for removing refrigerant from the unit 100. Opening of the solenoids 326, 288, 284, 323, 299, and 298 may be in sequence or simultaneous to allow any remaining refrigerant in the refrigerant recovery unit 100 to drain into the second refrigerant recovery unit 100'. At step 506, the pressure transducer 292, for example, records a pressure of the remaining refrigerant in the refrigerant recovery unit 100. A check is made to determine if the pressure is below a predetermined threshold, such as 10 pounds per square inch (psi), or approximately 20 inches of mercury. If the pressure is below the predetermined threshold, an output signal is provided to the controller 216 to continue to step 508. The second refrigerant recovery unit 100' may be disconnected. If the sensed pressure in the refrigerant recovery unit 100 is above the predetermined threshold, then the process returns to step 504.

At step 508, with refrigerant pressure less than the predetermined threshold in the refrigerant recovery unit 100, the controller 216 may initiate the vacuum pump 258 on the refrigerant recovery unit 100 to cycle for a predetermined amount of time in order to evacuate as much or all of the remaining first refrigerant residue. The software conversion program 610 directs the controller to open valves 276, 278 and 296 on the refrigerant recovery unit 100 and the vacuum cycle is scheduled to run for a specified amount of time between 15 minutes and two hours, preferably about one hour. Once it is determined at step 510 that the predetermined amount of time is complete, the unit 100 may be controlled to provide an audio and/or visual indication to the end user that the vacuum cycle is complete.

At step 512, the unit 100 may indicate via the display 110, for example, that it is the correct time in the conversion to replace the vacuum pump oil in container 257 as well as the refrigerant filter/dryer 264. Instructions 640 may also indicate the timing and associated procedures for each of the steps discussed herein. The end user may initiate the oil change procedure and exchange the used refrigerant filter/dryer 264 for the new refrigerant filter/dryer 620 from the conversion kit 600 in accordance with the guidelines and procedures outlined in the instructions 640 and/or the particular refrigerant recovery unit 100 operating/maintenance manual.

At step 514, the method 500 may not be permitted to continue until a signal is sent to the controller 216 that the filter/dryer 264 and vacuum pump oil have been changed. For example, the end user may be required to provide feedback via the user interface 114 in order to progress to the next step in the method 500.

Upon notification that the oil and filter/dryer 264 have been changed, as indicated by step 516, the unit 100 may indicate via the display 110, for example, that it is the correct time in the conversion to exchange the hoses 124 and 128. The end user may be prompted to remove the hoses 124 and 128 and replace with a new high pressure hose and a low pressure hose included in the new hose set 630 in the conversion kit 600. The end user may initiate and complete the hose exchange in accordance with the guidelines and procedures outlined in the instructions 640 and/or the particular refrigerant recovery unit 100 operating/maintenance manual. Step 516 may further require an indication that the hoses have been exchanged, which may be by a signal sent to the controller 216 that the new hose set 630 has been installed. For example, the signal may be triggered automatically upon replacement of the new hoses and/or the end user may be required to provide feedback via the user interface 114 in order to progress to the next step in the method 500.

As illustrated in step 518, with the hardware components effectively exchanged, the software conversion program 610 may initiate a vacuum cycle to prime the refrigerant recovery unit 100 for receipt of the new refrigerant. For example, the vacuum pump 258 may be run for a predetermined amount of time, for example, from 15 minutes up to a couple of hours, as indicated at step 520, and/or until a predetermined vacuum level, for example, below five (5) microns of mercury, is attained, as indicated at step 522. The method 500 may not be permitted to continue until the predetermined amount of time elapses in step 520 and/or the predetermined vacuum level is reached in step 522.

At step 524, the unit may be filled with a small amount of the new refrigerant. In order to obtain the new refrigerant from a refrigerant source, the refrigerant recovery unit 100 may include the tank fill structure 332, and valves 328 and 330. The tank fill structure 332 may be configured to attach to a refrigerant source. The valve 330 may be a solenoid valve and the valve 328 may be a check valve. In other embodiments, valve 330 may be a manually operated valve.

When controlled by the controller 216 to allow refrigerant from a refrigerant source to enter the refrigerant recovery unit 100, the tank fill structure 332 is attached to the refrigerant source and the tank fill valve 330 is opened. The check valve 328 prevents refrigerant from the refrigerant recovery unit 100 from flowing out of the refrigerant recovery unit 100 through the tank fill structure 332. The tank fill valve 330 may be connected to and controlled by the controller 216.

The tank fill structure 332 may be seated on the scale 334 that is configured to weigh the tank fill structure 332 in order to determine an amount of refrigerant stored in the tank fill structure 332. The scale 334 may be operatively coupled to the controller 216 and provide a measurement of a weight of the tank fill structure 332 to the controller 216. The controller 216 may cause a display of the weight of the tank fill structure 332. In this manner, for example, the unit 100 may be automated to receive a predetermined small amount of the new refrigerant as managed by the software conversion program 610, for example.

At step 526, a refrigerant identifier, which can be integrated into a separate maintenance unit and/or directly into the refrigerant recovery unit 100, may be used to identify the type of refrigerant in the system. The refrigerant identifier, or composition analyzing device, may be operatively engaged to the controller 216 to provide a composition data signal to the controller 216.

At step 528, a reading from the refrigerant identifier determines whether the composition of the refrigerant in the refrigerant recovery unit 100 is such that the purity level of the new refrigerant is above a predetermined threshold. If the purity level of the new refrigerant is at or above the predetermined threshold, the method 500 continues to step 530 and the unit 100 may be filled with the new refrigerant in preparation for use in services A/C systems on vehicles based on the new refrigerant. Otherwise, if the purity level reading of the refrigerant identifier indicates substantial contamination by the previous refrigerant, the unit 100 provides an indication to reattach the second refrigerant unit 100' and the process repeats beginning with step 504.

At step 532, with the refrigerant recovery unit 100 converted and ready for use with the new refrigerant, the embedded software on the unit 100 is updated to account for the new refrigerant.

It can be understood that the conversion kit and associated methods for converting an A/C system refrigerant recovery unit described and illustrated herein are examples only. The methods and apparatuses described herein can be used for any refrigerant including R-134a, however, the present disclosure can also be used for R-1234yf, CO2, and other similar refrigerant systems. It is contemplated and within the scope of the disclosure to construct a wide range of refrigerant recovery conversion kits to meet particular design and requirements in a wide range of applications.

It is to be understood that any feature described in relation to any one aspect may be used alone, or in combination with other features described, and may also be used in combination with one or more features of any other of the disclosed aspects, or any combination of any other of the disclosed aspects.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A method of converting a first refrigerant recovery unit using a first refrigerant to using a second refrigerant, the method comprising the steps of:

receiving a software conversion program that provides instructions to a controller to convert the first refrigerant recovery unit from using the first refrigerant to the second refrigerant;

opening, with the controller, solenoids along a refrigerant path to remove residue of the first refrigerant into a holding vessel of a connected second refrigerant recovery unit;

determining, with a pressure transducer, if a pressure of the remaining first refrigerant is less than 10 p.s.i. in the first refrigerant recovery unit;

operating a vacuum pump of the first refrigerant recovery unit, by the controller, to further remove any remaining first refrigerant from the refrigerant path if the determined pressure of the first refrigerant is less than 10 p.s.i.;

exchanging a first oil of the vacuum pump with a second oil and replacing a first filter with a second filter;

after having changed the first oil and the first filter, receiving, by the controller, an indication that the first oil of the vacuum pump and the first filter have been changed;

replacing a first high pressure hose, and a low pressure hose with a second high pressure hose and a second low pressure hose;

after having replaced the first high pressure hose and the first low pressure hose, receiving, by the controller, an indication that the first high pressure hose and the first low pressure hose have been changed with the second high pressure hose and the second low pressure hose;

introducing, via the controller, a first amount of the second refrigerant into the refrigerant path after receiving the indication that the first oil of the vacuum pump, the first high pressure hose, the low pressure hose and the first filter have been changed; and determining, with a refrigerant identifier, a purity of the second refrigerant in the refrigerant path before adding a second amount of the second refrigerant.

2. The method according to claim 1 further comprising the step of:

operating the vacuum pump for a predetermined amount of time.

3. The method according to claim 1 further comprising the step of:

powering on the first refrigerant recovery unit to automatically run the software conversion program.

4. The method according to claim 1, further comprising the step of:

powering on the first refrigerant recovery unit to automatically run the software conversion program.

5. The method according to claim 4, wherein the notification is an audio alert or a visual alert.

6. The method according to claim 4 further comprising the step of:

receiving a signal through a user interface to dismiss the notification.

7. The method according to claim 1 further comprising the step of:

reconfiguring software settings on the first refrigerant recovery unit.

8. The method according to claim 1 further comprising the step of:

repeating all of the steps if the purity of the second refrigerant is below a predetermined threshold.

9. The method according to claim 1, wherein the first refrigerant is R-134a and the second refrigerant is R-1234yf.

10. A conversion kit for a first refrigerant recovery unit comprising:

a software conversion program for installing on the first refrigerant recovery unit, the software conversion programs provides instructions to a controller of the first refrigerant recovery unit to convert the first refrigerant recovery unit that uses a first refrigerant to using a second refrigerant, the instructions include:

open, with the controller, solenoids along a refrigerant path to remove the first refrigerant into a holding vessel of a connected second refrigerant recovery unit;

determine, with a pressure transducer, if a pressure of the remaining first refrigerant is less than 10 p.s.i. in the first refrigerant recovery unit;

operate a vacuum pump of the first refrigerant recovery unit, by the controller, to further remove any remaining first refrigerant from the refrigerant path if the determined pressure of the first refrigerant is less than 10 p.s.i.;

after having changed a first oil of the vacuum pump and a first filter, receiving, by the controller, an indication that the first oil of the vacuum pump and the first filter have been changed;

after having replaced the first high pressure hose and the first low pressure hose, receiving, by the controller, an indication that the first high pressure hose and the first low pressure hose have been changed with a second high pressure hose and a second low pressure hose;

introduce, via the controller, a first amount of the second refrigerant into the refrigerant path after receiving the indication that the first oil vacuum pump and the first filter have been changed; and determine, with a refrigerant identifier, a purity of the second refrigerant in the refrigerant path before adding a second amount of the second refrigerant;

a second filter that replaces the first filter on the first refrigerant recovery unit, the first filter having the residue of the first refrigerant;

the second high pressure hose that replaces the first high pressure hose on the refrigerant recovery unit, the first high pressure hose having been in contact with the first refrigerant; and the second low pressure hose that replaces the first low pressure hose on the refrigerant recovery unit, wherein the first low pressure hose having been in contact with the first refrigerant.

11. The conversion kit according to claim 10 further comprising:

a re-usable refrigerant tank that stores the first refrigerant.

12. The conversion kit according to claim 10 further comprising a manual that includes instructions for converting the refrigerant recovery unit.

13. The conversion kit according to claim 10, wherein the first refrigerant is R-134a and the second refrigerant is R-1234yf.

* * * * *